US006462653B1

(12) United States Patent
Scorfield et al.

(10) Patent No.: US 6,462,653 B1
(45) Date of Patent: Oct. 8, 2002

(54) SYSTEM AND METHOD OF GROUP DEFINITION

(75) Inventors: Steven L. Scorfield, Glendale Heights; Daniel C. Hawkinson, Elburn; Mark C. Bohanon, Lisle, all of IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/459,969

(22) Filed: Dec. 13, 1999

(51) Int. Cl.[7] ..... G08B 29/00

(52) U.S. Cl. ..... 340/506; 340/505; 340/510; 340/511; 340/514; 340/518; 340/10.31

(58) Field of Search ..... 340/506, 518, 340/505, 510, 511, 514, 10.31

(56) References Cited

U.S. PATENT DOCUMENTS 4,916,432 A 4/1990 Tice et al.
4,918,690 A 4/1990 Markkula, Jr. et al.
4,969,147 A 11/1990 Markkula, Jr. et al.
5,400,246 A * 3/1995 Wilson et al. ..... 340/825.06 X
5,513,324 A 4/1996 Dolin, Jr. et al.
5,519,878 A 5/1996 Dolin, Jr.
5,539,389 A 7/1996 Bystrak et al.

* cited by examiner

*Primary Examiner*—Daryl Pope
(74) *Attorney, Agent, or Firm*—Welsh & Katz, Ltd.

(57) ABSTRACT

An event detection system has a control element coupled to a plurality of detectors, such as smoke detectors. The control element can be implemented with a programmed processor. The detectors can include a base which removably receives a separable detector housing and electronics. Group boundaries can be specified by incorporating boundary defining electrical elements, such as switches or resistors, into either a respective detector base or into the detector itself. The control element can include instructions for carrying out an automatic addressing process with respect to the detectors. Topology information obtained during the automatic addressing process in combination with the location of the boundary defining elements specifies one or more groups for the control element. In an alternate embodiment, groups can be defined based exclusively on the topology information. In this embodiment, boundary defining electrical elements are not needed.

40 Claims, 2 Drawing Sheets

SYSTEM AND METHOD OF GROUP DEFINITION

FIELD OF THE INVENTION

The invention pertains to event detection systems which include predefined groups of event detectors. More particularly, the invention pertains to such systems wherein groups can be automatically defined independently of specific detectors that might be installed in the system.

BACKGROUND OF THE INVENTION

Event detection systems, such as burglar or fire alarm systems have been recognized as being useful in providing warnings of the existence of events of interest such as intrusion or fire. One known form of such a system is disclosed in Tice et al. U.S. Pat. No. 4,916,432 entitled "Smoke and Fire Detection Communication" and assigned to the assignee hereof. The Tice patent is hereby incorporated by reference herein.

In such systems, it has been recognized that it is at times advantageous to group detectors for processing purposes. One known approach is to load group information into detectors. It can also be loaded into the system control panel, assuming that the system has such a panel.

One group might include all detectors on a given floor of the building. Another group might all detectors in a portion of a floor of a building.

Grouping detectors together makes it possible to take into account the particular physical characteristics of the region of the building being monitored. It is also known to couple groups of detectors, via a communication link, to a common control element which might include one or more programmed processors. The control element receives information from the detectors for the purpose of determining if a fire profile is being reported via detector or by a group of detectors.

One system which illustrates the use of groupings is disclosed and claimed in U.S. Pat. No. 5,539,389 entitled Device Group Communication for Fire, Security and Control Systems assigned to the assignee hereof. The disclosure of the '389 patent is incorporated herein by reference.

In such systems it is also known to from time to time remove and replace detectors for service or maintenance purposes. In such situations, group information might have to be loaded into the replacement detector or detectors. Alternately, when a system is being installed, group information must be supplied to the control panel.

It would be desirable to be able to supply group information to the panel substantially automatically. It would also be desirable to replace detectors without either losing group information or having to load the replacement detectors with group information.

It is also been recognized that since monitoring systems may include significant numbers of detectors that it is desirable for the system to carry out automatic address assignment to detectors being installed in the system. One form of automatic addressing is disclosed in Tice pending United States patent application entitled Electronic Self-Locating System and Method filed May 19, 1997, Ser. No. 08/858,625. The disclosure of the Tice application is incorporated herein by reference.

It would be desirable to be able to maximize the cost effectiveness and the efficiency benefits achieved by automatic addressing systems by minimizing the labor required to define groups of detectors for the control element. Preferably, it would be possible to automatically define groups, once addresses were automatically assigned. Also, it would be preferable if the introduction of automatic group definition did not require a substantial additional, hence expensive, hardware and software.

SUMMARY OF THE INVENTION

Group defining devices can be attached to electrical units at the time of installation. Such devices enable a common control unit, coupled to the electrical units via a communications link, to determine logical groupings of devices. This promotes simplified installation of the system.

Groups can be automatically defined in an event detection system by coupling a group marker to a base of a boundary detector for the group. For example, a group end marker could be coupled to the base of the appropriate detector. Replacing the detector does not alter the location of such end markers.

End markers can be implemented with electronic components coupled to the bases of respective detectors. Exemplary markers include switches, resistors or capacitors. Other components, including mechanical members mounted in the base or bases could be used without limitation.

In one aspect, both start and end markers could be used. Alternately, only start markers need be used.

At installation, the system control panel can carry out any one of the known automatic addressing methods, such as the method disclosed in the above-noted Tice U.S. Application. Such systems usually inform the control panel of the topology of the detectors coupled to the system.

Once the control element has information, automatically obtained, concerning detector topology The group marker or markers automatically define the groups even in the presence of replacement detectors installed after the fact.

In one aspect, an electrical element can be coupled to at least one electrical unit which, relative to a communications link, defines a boundary of the group. This element can be coupled to the respective electrical unit in a variety of ways. All that is required is that the respective electrical unit be able to sense that it is a group boundary establishing unit. In one embodiment, the element can be coupled to a base which removably receives a detector.

In yet another aspect, group boundaries can be established by coupling a detectable boundary identifying element such as a resistor or a switch to a boundary defining electrical unit. The presence of this element can be sensed by the electrical unit. This information can be provided to the control element in response to an appropriate command. The control element can in turn use the information to define which electrical units are associated with which group.

One resistor, for example, with respect to a first electrical unit, signifies one boundary of the group, relative to the communication link. Another resistor, relative to the second electrical unit defines the other boundary.

In yet another aspect, the topology can be used to define the group or groups. For example, a group could be defined as including all detectors on a pair of communications lines coupled directly, or indirectly, to the control element. A different pair of lines could define another group which includes all detectors coupled to the different pair of lines. In this embodiment, group definition can be effected without the attachment of group markers to detector bases.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
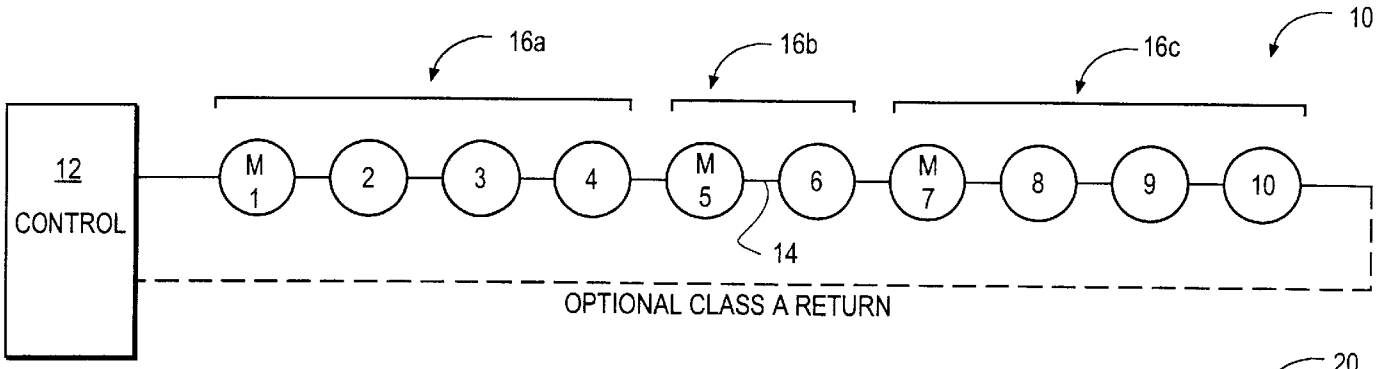
FIG. 1 is a block diagram illustrating group definition in accordance herewith.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 3:
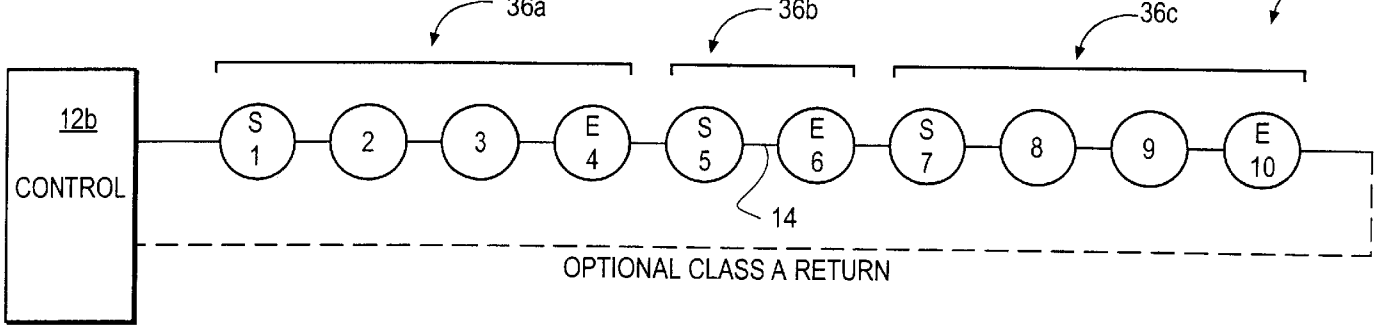
FIG. 3 is a block diagram illustrating yet another alternate form of group definition.
Figure 4:
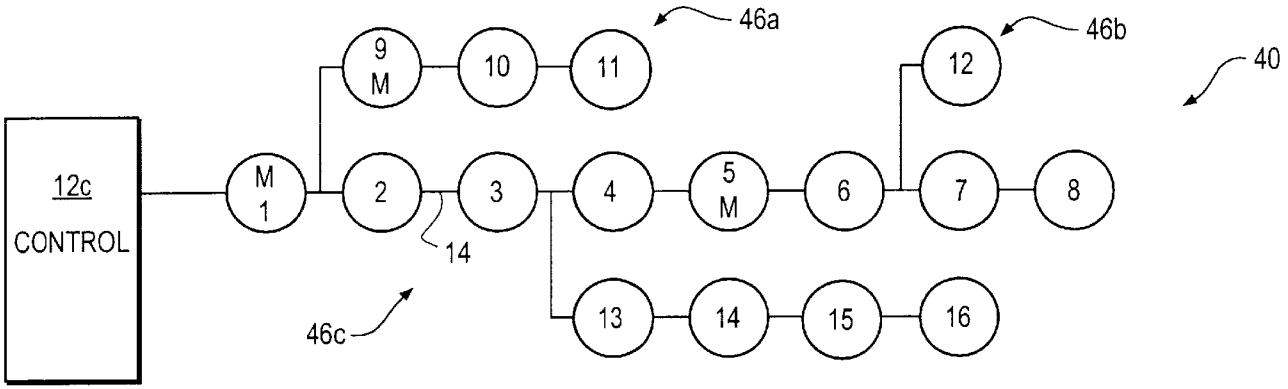
FIG. 4 is a block diagram illustrating yet another alternate form of group definition.
Figure 5:
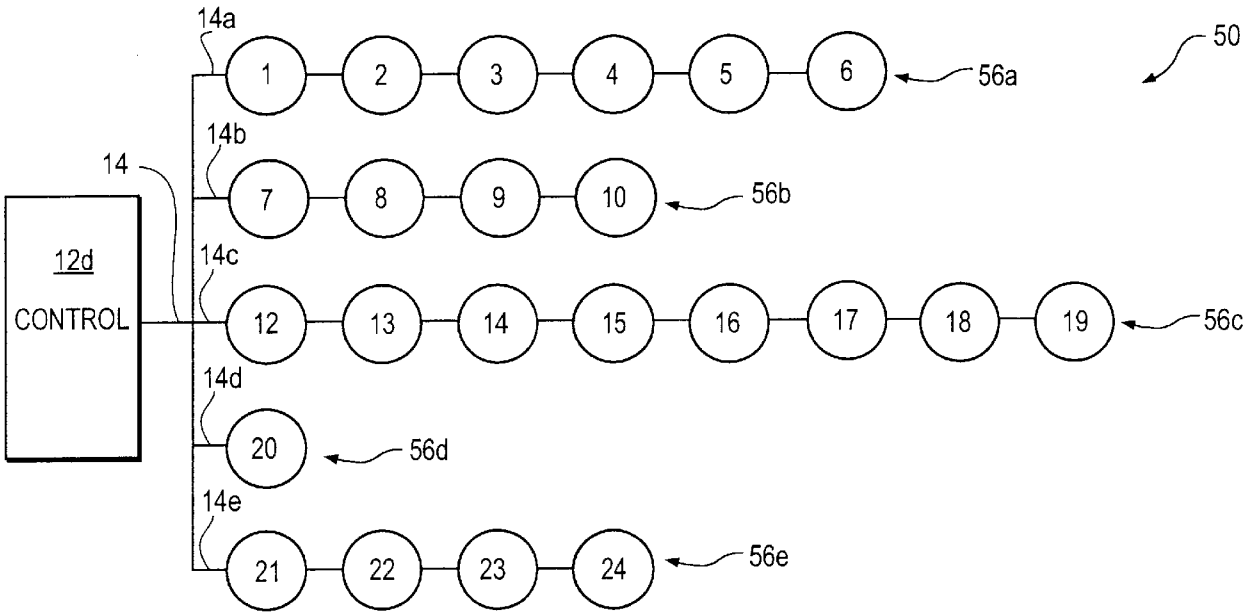
FIG. 5 is a block diagram of yet another form of group definition.

FIGS. 1 through 5 illustrate various methodologies of defining groups in accordance herewith. In FIGS. 1 through 4, various types of markers are associated with boundary electrical units for purposes of defining groups. In FIG. 5, system topology is used to define the beginning and/or end of a group.

The term "marker" is being used to indicate a device such as a switch, a resistor, a capacitor, a breakaway tab, a removable shorting bar or the like which can be associated with a selected electrical unit and subsequently detected either at the unit or remotely for the purpose of indicating a group or zone boundary. In one embodiment, assuming the electrical units have separable bases, the marker or markers can be installed in the respective base or bases. This embodiment is advantageous in that if electrical units are replaced or exchanged for maintenance purposes or other service, the location of the markers defining the respective group or zone boundaries are unchanged. Alternately, the markers could be directly coupled to the respective electrical unit or units.

FIG. 1 illustrates an exemplary system 10 which could, for example, be an event detection system. Representative examples would include fire alarm or burglar alarm systems.

The system 10 includes a control element 12 which is in turn coupled to a communications medium 14. The medium 14 can be implemented with electrical or optical cable.

Coupled to the medium 14 are three pluralities of electrical units 16*a*, 16*b*, 16*c*. Each plurality represents a predefined group of electrical units. The members of these pluralities can be, for example, in communication with another as well as the control element 12

The group 16*a* includes electrical units numbered 1 through 4. One boundary for group 16*a* is a marker associated with electrical unit 1. A second boundary is a marker associated with electrical units 5 associated with group 16*b*.

The group or plurality 16*b* is in turn defined by a boundary marker associated with electrical unit 5 and a second boundary is defined by a marker associated with electrical unit 7 of group 16*c*. Finally, group 16*c* has a first boundary defined by a marker associated with electrical unit 7 and extends until another marker is encountered or the medium 14 is returned to control element 12.

It will be understood that the initial boundary marker for group 16*a*, associated with electrical unit 1, is optional. It will also be understood that the electrical units 1 through 10 can carry out a wide variety of functions without departing form the spirit and scope of the present invention. Representative functions include sensing ambient conditions such as fire or gas, motion, position or the like, all without limitation. The details of the various electrical units 1 through 10 are not limitations of the present invention.

As noted above, the respective markers associated with electrical units 1, 5 and 7, of system 10, could be directly coupled to the respective electrical unit. Alternately, if the unit is interconnected to system 10 via a removably engageable base, the respective markers can be installed on the base.

Figure 2:
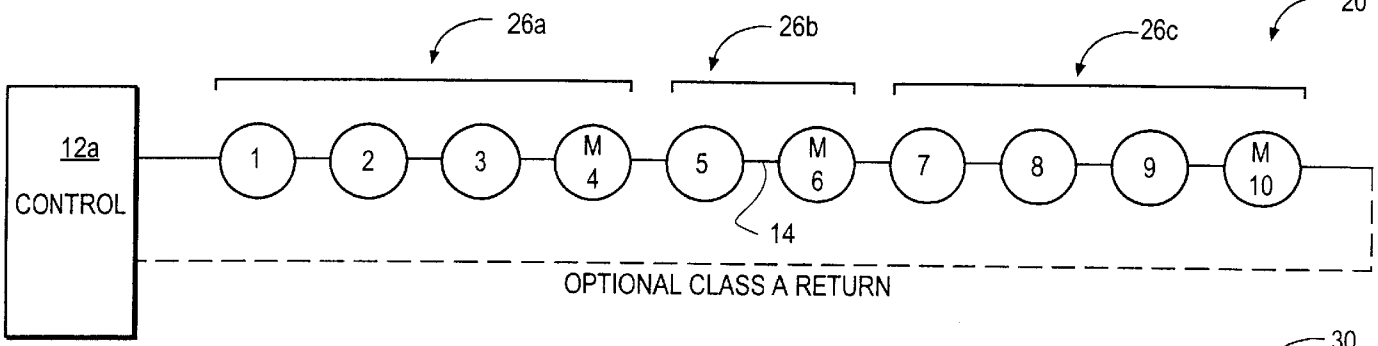
FIG. 2 is a block diagram illustrating an alternate form of group definition.

FIG. 2 illustrates a system 20 which includes a control element 12a comparable to the element 12 of FIG. 1. The system 20 also includes a bidirectional communications medium, such as the medium 14, as noted above.

In the system 20, markers are associated with ending boundaries of groups or zones. For example, proceeding from control element 12*a*, electrical units 1 through 4, coupled to medium 14, form a first zone or group 26*a*. An end boundary for the group is signified by a marker associated with electrical unit 4.

A second group 26*b* includes electrical units 5 and 6. An end boundary for group 26*b* is defined by a marker associated with electrical units 6.

Group 26*c*, electrical units 7 through 10. An end boundary is defined by a marker associated with electrical unit 10.

FIG. 3 illustrates a system 30 which incorporates a control element 12*b* comparable to the control element 12 of FIG. 1. The system 30 includes a bidirectional communication medium, such as the medium 14, coupled to the control element 12*b*.

System 10 also includes three predefined groups or zones 36*a*, 36*b*and 36*c*. The initial group 36*a* is bounded by a start marker associated with electrical unit 1 and an end marker associated with electrical unit 4. The group 36*b* is bounded by a start marker associated with electrical unit 5 and an end marker associated with electrical unit 6. Finally, group 36*c* is defined between a start marker associated with electrical unit 7 and an end marker associated with electrical unit 10.

FIG. 4 illustrates a system 40 which has a somewhat more complex topology than that previously illustrated in systems 10, 20 and 30. In the system 40, a control element 12*e*, comparable to the control element 12 of FIG. 1, is coupled to a bidirectional communications medium 14.

System 40 includes groups or zones 46*a*, 46*b* and 46*c*. Each of the groups is defined by a starting marker and extends until another starting marker is encountered or the communication medium 14 returns to the control element 12*e*.

Group 46*a* includes electrical units 9, 10 and 11. The group 46*a* has an initial boundary defined by a marker at electrical unit 9. Electrical unit 11 is the last member of the group 46*a*. The end of the group is indicated in that medium 14 extends from electrical unit 11 back to control element 12*e* perhaps through some form of line terminating or end of line resistor element.

Group 46*b* includes electrical units 5 through 8 and 12. This group is defined by an initial marker associated with electrical unit 5. Group ends are defined by the communication medium 14 extending from the respective units such as 8 or 12, through a termination or end of line resistor, for example back to control element 12*e*.

Group 46*c* which includes electrical units 1 through 4, and 13 through 16, is initially defined by a marker associated with electrical unit 1. An ending boundary, adjacent electrical unit 4, is indicated by the marker associated with electrical unit 5, which indicates also the start of group 46*b*. The group 46*c* also has a second end boundary at electrical unit 16.

FIG. 5 illustrates a system 50 wherein groups are defined by the arrangement of electrical units relative to the communications medium. The system 15 includes a control element 12*d* comparable to the control element 12 of FIG. 1.

Groups of electrical units 56*a*, 56*b*, . . . 56*e* are defined by the topology of the various electrical units relative to the communication medium. For example, each of the groups could be defined by the fact that the respective electrical units are all coupled to a branch 14*a*, 14*b*. . . 14*e* of the communication link 14. In this embodiment, no boundary markers are necessary.

Control panel 12*d*, as a result of having executed an automatic addressing process, as noted above, includes a record of the topology of the system. Hence, groups can be immediately defined based on that topology. In the event that one of the groups, such as group 56*a*, incorporates a second tap with additional electrical units thereon, those electrical units can be regarded as being in the same or a different group.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An event detection system comprising:

a plurality of independently functioning event detectors wherein at least some of the detectors define group boundaries by the presence of selected electronic components coupled directly to respective ones of the boundary defining detectors, and wherein at least some of the event detectors are associated with a group without the presence of the selected electronic components coupled directly thereto, due to the location of the non-group boundary defining detectors relative to the detectors which define group boundaries.

2. An event detection system as in claim 1 which includes a control element in communication with the detectors wherein the control element includes circuitry for detecting the presence of at least one of the boundary defining electronic components.

3. An event detection system as in claim 2 wherein the control element includes a programmed processor and the circuitry includes prestored instructions for detecting the location of boundary detecting components .

4. An event detecting system as in claim 2 wherein the components are selected from a class which includes resistors, capacitors, and switches.

5. An event detection system as in claim 1 wherein at least the boundary defining detectors comprise a base and a separable housing wherein the respective component is carried by the base.

6. An event detection system as in claim 1 wherein at least some of the detectors comprise fire detectors.

7. An event detection system as in claim 3 which includes executable instructions for carrying out an automatic addressing process.

8. An event detection system as in claim 1 which includes different boundary defining components, each separately corresponding to group start components and group end components.

9. An event detection system as in claim 3 wherein the boundary defining detectors include circuitry for sensing the presence of any boundary defining component coupled to the respective detector.

10. Apparatus for determining a group of electrical units, each of the electrical units being independently addressable, comprising:

a plurality of electrical units wherein each of the units includes control circuitry for bidirectional communications;

at least first and second group identifier circuits wherein the identifier circuits are coupled to respective first and second group defining members of the plurality wherein selected members of the plurality, along with the first and second group defining members, form a group and wherein the presence of the identifier circuits can be remotely detected, thereby enabling the members of the group including one or more non-group defining members to be remotely determined.

11. Apparatus as in claim 10 wherein the group identifier circuits comprise at least a resistor.

12. Apparatus as in claim 10 wherein the group identifier circuits comprise at least one of a mechanically settable switch, a resistor, and a capacitor.

13. Apparatus as in claim 10 wherein the group identifier circuits comprise an electrical component, whose presence can be remotely sensed and which uniquely defines a group boundary.

14. An apparatus as in claim 10 which includes a communications link for carrying out bidirectional communication, at least between some of the units.

15. An apparatus as in claim 14 which includes a common control element coupled to the link wherein the element includes circuitry for remotely detecting group boundaries.

16. A monitoring system comprising:

a common control element;

a plurality of electrical units wherein the units each include circuitry for at least unidirectional communication with the common control element;

first and second group boundary defining devices wherein the devices are each coupled to a different electrical unit in the same group to define group boundaries wherein the common control element includes circuitry for establishing the remaining electrical units of the group, which are not coupled to group boundary defining devices.

17. A monitoring system as in claim 16 wherein each of the devices comprises a boundary defining current carrying element.

18. A monitoring system as in claim 17 wherein the current carrying element includes a resistor.

19. A monitoring system as in claim 17 wherein those electrical units coupled to respective ones of the devices also include an ambient condition detector.

20. A monitoring system comprising:

a control element;

a communications link;

a plurality of ambient condition detecting devices coupled to the link wherein the element includes executable instructions for developing topology information for the devices coupled to the link, including both group boundary determining devices and non-group boundary determining devices; and additional instructions for defining groups based at least in part on the topology information, and at least in part on the location of the group boundary determining devices;

which includes a plurality of boundary defining components coupled to respective devices for defining group boundary determining devices, wherein in the absence of the boundary defining components being coupled to a particular device, the device is defined as a non-group boundary determining device.

21. A system as in claim 20 wherein the components are selected from a class which includes resistors, capacitors, and switches.

22. A system as in claim 20 wherein at least the boundary defining devices comprise a base and a separable housing wherein the respective component is carried by the base.

23. A system as in claim 22 wherein at least some of the devices comprise fire detectors.

24. A system as in claim 20 which includes executable instructions for carrying out an automatic addressing process.

25. A system as in claim 20 which includes different boundary defining components, each separately corresponding to group start components and group end components.

26. A system as in claim 20 wherein the boundary defining devices include circuitry for sensing the presence of any boundary defining component coupled to the respective device.

27. A system as in claim 20 which includes:

first and second group boundary defining components wherein the components are each coupled to a different electrical device in the same group to define group boundaries wherein the control element includes circuitry for establishing the remaining members of the group.

28. A system as in claim 27 wherein each of the components comprises a boundary defining current carrying element.

29. An event detection system comprising:

a communication link;

a common control element coupled to the communication link;

a plurality of event detectors, each of which is coupled to the communication link and capable of communicating with the common control element via the communication link, wherein at least some of the detectors define group boundaries by the presence of selected electronic components coupled to respective ones of the boundary defining detectors, thereby defining groups of event detectors wherein at least some of the groups of event detectors comprise a plurality of event detectors including both boundary defining detectors and non-boundary defining detectors.

30. An event detection system as in claim 29 wherein the control element includes a programmed processor and the circuitry includes prestored instructions for detecting the location of boundary detecting components.

31. An event detecting system as in claim 29 wherein the components are selected from a class which includes resistors, capacitors, and switches.

32. An event detection system as in claim 29 wherein at least the boundary defining detectors comprise a base and a separable housing wherein the respective component is carried by the base.

33. An event detection system as in claim 29 wherein at least some of the detectors comprise fire detectors.

34. An event detection system as in claim 30 which includes executable instructions for carrying out an automatic addressing process.

35. An event detection system as in claim 29 which includes different boundary defining components, each separately corresponding to group start components and group end components.

36. An event detection system as in claim 31 wherein the boundary defining detectors include circuitry for sensing the presence of any boundary defining component coupled to the respective detector.

37. A communication system comprising:

a control unit;

a plurality of devices that receive and transmit information between each other and the control unit via a common medium;

wherein one or more of the plurality of devices is capable of attachably receiving a group boundary designating component, and has a processor which is adapted for sensing the attachment of a group boundary designating component and identifying itself as a group identifier to the control unit while the group boundary designating component is attached; and wherein the control unit downloads group information to the plurality of devices via the common medium based upon the information received from the one or more of the plurality of devices identifying itself as a group identifier.

38. A communication system as in claim 37 wherein the group boundary designating components are selected from a class which includes resistors, capacitors, and switches.

39. A communication system as in claim 37 wherein least some of the one or more of the plurality of devices identified as a group identifiers comprise a base and a separable housing wherein the respective component is carried by the base.

40. A communication system as in claim 37 wherein at least some of the plurality of devices comprise fire detectors.

* * * * *